US008397691B2

(12) United States Patent
Osawa et al.

(10) Patent No.: US 8,397,691 B2
(45) Date of Patent: Mar. 19, 2013

(54) WORK APPARATUS WITH INTERNAL COMBUSTION ENGINE

(75) Inventors: Hisato Osawa, Tokyo (JP); Kosuke Matsumoto, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 615 days.

(21) Appl. No.: 12/556,028

(22) Filed: Sep. 9, 2009

(65) Prior Publication Data

US 2010/0077985 A1 Apr. 1, 2010

(30) Foreign Application Priority Data

Sep. 30, 2008 (JP) ..... 2008-254947

(51) Int. Cl.
*F02B 77/00* (2006.01)

(52) U.S. Cl. ..... 123/198 E; 123/195 C; 30/381

(58) Field of Classification Search ..... 123/198 E, 123/195 C; 30/381
See application file for complete search history.

(56) References Cited

U.S. PATENT DOCUMENTS

| | | | | |
|---|---|---|---|---|
| 3,731,846 | A * | 5/1973 | Turner et al. | 222/86 |
| 4,594,083 | A * | 6/1986 | Hiraizumi | 55/385.3 |
| 4,793,303 | A * | 12/1988 | Nagashima | 123/198 E |
| 4,953,526 | A * | 9/1990 | Hironaka et al. | 123/182.1 |
| 5,522,355 | A * | 6/1996 | Uhl | 123/198 E |
| 5,595,153 | A | 1/1997 | Höppner et al. | |
| 5,899,182 | A * | 5/1999 | Martinsson et al. | 123/90.38 |
| 6,536,395 | B1 * | 3/2003 | Schliemann | 123/184.46 |
| 6,941,921 | B2 * | 9/2005 | Yazaki et al. | 123/195 C |
| 7,082,919 | B2 * | 8/2006 | Nonogaki et al. | 123/198 E |
| 7,424,879 | B2 | 9/2008 | Schlauch et al. | |
| 7,441,525 | B2 * | 10/2008 | Jessberger et al. | 123/90.37 |
| 7,647,913 | B2 * | 1/2010 | Kohler et al. | 123/198 E |
| 7,810,598 | B2 * | 10/2010 | Nonogaki | 180/69.22 |
| 7,905,261 | B2 * | 3/2011 | Hamisch et al. | 150/157 |
| 2007/0034187 | A1 * | 2/2007 | Menzel et al. | 123/198 E |

FOREIGN PATENT DOCUMENTS

| | | |
|---|---|---|
| JP | 2006-066679 | 3/2006 |
| JP | 2006-125405 | 5/2006 |

* cited by examiner

*Primary Examiner* — Noah Kamen
*Assistant Examiner* — Grant Moubry
(74) *Attorney, Agent, or Firm* — Kilyk & Bowersox, P.L.L.C.

(57) ABSTRACT

A work apparatus having an internal combustion engine includes a body case (100) that houses the engine and other components of the apparatus and a hood (102) that removably covers a top opening of body case (100). The hood (102) has an inclined pin (104) extending aslant downward toward one end of the hood (102) from a portion near the one end. The body case has an inclined bore (106) for receiving the inclined pin (104). A rear end portion of the hood (102) is locked to the body case (100) by a known lock means. The inclined pin (104) wears an elastic tube (112) on its outer circumference.

18 Claims, 12 Drawing Sheets

WORK APPARATUS WITH INTERNAL COMBUSTION ENGINE

CROSS REFERENCE TO RELATED APPLICATIONS

The present application claims priority from Japanese Patent Application No. 2008-254947, filed Sep. 30, 2008, which is incorporated herein by reference.

FIELD OF THE INVENTION

The present invention relates to a work apparatus equipped with an internal combustion engine, such as chain saws, brush cutters or the like, and in particular, to a latching and releasing structure of a hood that covers an open top end of a body case that opens upward.

BACKGROUND OF THE INVENTION

Chain saws, brush cutters and trimmers, among others, are known as work apparatuses with a compact internal combustion engine. U.S. Pat. No. 5,595,153 (Patent Document 1) relates to a hood for covering an open top end of a body case that incases and encircles an internal combustion engine and an adjacent air filter box. This patent proposes a hood having a front end pivoted about a pivot axis held on the body case and having an open/close knob at its rear end. The open top end of the body case can be uncovered by unlocking the engagement of the hood with the body case at the open/close knob and then rotating the hood upward about the pivot axis at the front end. The pivot axis at the front end of the body case can be locked at or released from a bearing portion of the body case. The bearing portion of the body case has a channel-shaped configuration opening rearward in its side view. When the hood is moved rearward, the pivot axis disengages from the channel-shaped bearing portion through its back-faced aperture, and the hood can be removed from the body case.

Japanese Patent Laid-open Publication No. 2006-125405 (Patent Document 2 equivalent to U.S. Pat. No. 7,424,879) discloses an invention that is common to the Document 1 in that the front end of the hood is pivotally supported on the body case. A difference between these Patent Documents lies in that Patent Document 2 uses a slider linearly movable back and forth instead of the open/close knob of Patent Document 1 to lock and release the hood relative to the case body by operating the slider.

Patent Documents 1 and 2 have an advantage permitting a user to access to the air filter box or an engine by opening the hood without a tool. However, such a structure for pivotally supporting one end of a hood to a case body as employed by Patent Documents 1 and 2 involves the problem that the bearing portion of the case body is liable to break.

Especially in Patent Document 1, the side-viewed channel-shaped bearing has a larger possibility to break because of a load applied upon receiving or releasing the pivot axis. To prevent it, the bearing portion needs a design having a high strength.

SUMMARY OF THE INVENTION

It is therefore an object of the invention to provide a work apparatus with an internal combustion engine, in which a hood can be removed from a body case without a tool.

A further object of the present invention is to provide a work apparatus with an internal combustion engine, having a structure that makes it easy to attach the hood and reliably prevents the hood from inadvertent disengagement in a condition fixed to the body case.

To attain these objects of the invention, there is provided a work apparatus with an internal combustion engine, comprising:

a body case housing the internal combustion engine and having an open top end;

a hood for covering said open top end of the body case;

an inclined pin extending aslant downward from a portion near to one end of said hood such that a distal end of the inclined pin is nearer to said one end of the hood than a proximal end of the inclined pin;

an inclined bore provided at a position of said body case for confrontation with said inclined pin and having an open end opening upward, said inclined bore being configured such that a deep end thereof is nearer to one end of the body case corresponding to said one end of the hood than said open end of the inclined bore; and a lock means for releasably locking a portion of said hood including the other end thereof to a portion of the body case including the other end thereof.

The present invention has the basic concept explained below with reference to FIGS. 1 and 2. The open top end of the body case (100) is covered by a hood (102). The hood (102) is detachably held on the body case (100), and can be removed from the body case (100). The hood (102) has an inclined pin (104) at a portion near to one end thereof. As best shown in FIG. 2, the inclined pin 104 inclines to be nearer to the said one end at its distal end (104*b*) rather than at its proximal end (104*a*). That is, the inclined pin (104) extends aslant downward toward the said one end of hood (106). FIG. 18 shows the same components with the inclined pin (104) extending upward from the body case (100), and wherein the inclined bore (106) is located in the hood (102).

The body case (100) has an inclined bore (106) for receiving the inclined pin (104). As best shown in FIG. 2, the inclined bore (106) has an upward opened configuration and it is formed at a position for confrontation with the inclined pin (104) of the hood (102). The inclined bore (106) is configured to be nearer to one end of the body case (100), which corresponds to the said one end of the hood (102), at its deep end (106*b*) than at its open end (106*a*). That is, the inclined bore (106) extends aslant downward from the open end (106*a*) such that the deeper it is, the nearer to the said one end of the body case (100).

With this configuration, when the hood (102) is mounted to the body case (100), the hood (102) can be fixed in position relative to the body case (100) by inserting the inclined pin (104) of the hood (102) into the inclined bore (106) of the body case and then sliding the hood (102) in a direction for bringing the inclined pin (104) deepest into the inclined bore (106). Then, the hood (102) can be locked to the body case (100) by locking the other end of the hood (102) to the body case (100) with any appropriate one of known locking means including those used in Patent Documents 1 and 2. In short, the hood (102) is reliably held with its one end on the body case (100) by engagement of the complementary pin (104) and bore (106) and it is prevented from unintended upward separation at that end.

For more accurate and easier positioning of the hood (102) upon mounting it on the body case (100), a complementary concave-convex engagement between the body case (100) and the hood (102) may be used. In the example shown in FIGS. 1 and 2, the body case (100) has a projection (108) projecting upward, and the hood (102) has a recess (110) at a position for confrontation with the projection (108). However, the concave-convex relation may be reversed such that the hood (102) has a projection (108) whereas the body case (100) has a recess (110).

To prevent looseness or displacement of the hood (102) relative to the body case (100), the lock means of the hood (102) may be configured to urge the hood (102) forward and thereby apply a biasing force to the inclined pin (104). However, a more reliable method is to use an elastic tube, explained later, in combination with the inclined pin (104). In this case, it is desirable to make a slight difference between angles of inclination of the inclined pin (104) and the inclined bore (106) such that the elastic tube is partly compressed in the inclined bore (106).

The inclined pin (104) may have the form of a straight pin as shown in FIGS. 1 and 2 or may be a slightly curved or bent pin. Similarly, the inclined bore (106) may be either a straight bore or a slightly curved or bent bore.

With reference to FIG. 3 showing an alternative design of the inclined pin (104) of the hood (102), the inclined pin (104) may be configured to have a larger diameter at the proximal end (104*a*) than at the distal end (104*b*) such that the proximal end (104*a*) is approximately equal in diameter to the open end (106*a*) of the inclined bore (106) in the body case (100). In this manner, the said one end of the hood (102) is just fit in position relative to the body case (100) when the inclined pin (104) enters deepest into the inclined bore (106). This modification may be further modified as shown in FIG. 4 in which the elastic tube (112) that envelopes the inclined pin (104) has a two-stepped configuration including an upper half (112*a*) with a larger diameter and a lower half (112*b*) with a smaller diameter.

The inclined pin (104) of the hood (102) may be provided either at only one side or at right and left both sides of a front end, or of one end of the hood (102), depending upon the position and number of the lock means and the width of the locking part of the hood (102) acting as the lock means. Further, the hood (102) may have an indented portion at its one end to make a space S between the hood (102) and the body case (100) at least near the inclined pin (104) (FIG. 1). This design permits a user to insert his/her fingers when removing the hood (102) from the body case (100) and makes it easy to raise the said one end of the hood (102) and then pull the inclined pin (104) out of the inclined bore (106) with the fingers.

All of the above-explained exemplary structures have been explained as providing the inclined pin (104) on the part of the hood (102) and the inclined bores (106) on the part of the body case (100). However, opposite structures providing an inclined pin (104) on the body case (100) and an inclined bore (106) in the hood (102) are also usable.

According to another aspect of the invention, there is provided a work apparatus with an internal combustion engine, comprising:

a body case housing the internal combustion engine and having an open top end;

a hood for covering said open top end of the body case;

an inclined pin extending aslant upward from a portion near to one end of said body case such that a distal end of the inclined pin is nearer to said one end of the body case than a proximal end of the inclined pin;

an inclined bore provided at a position of said hood for confrontation with said inclined pin and having an open end opening downward, said inclined bore being configured such that a deep end thereof is nearer to one end of the body case corresponding to said one end of the hood than said open end of the inclined bore; and a lock means for releasably locking a portion of said hood including the other end thereof to a portion of the body case including the other end thereof.

DETAILED DESCRIPTION OF THE INVENTION

Preferred embodiments of the invention will now be explained with reference to the drawings.

Figure 1:
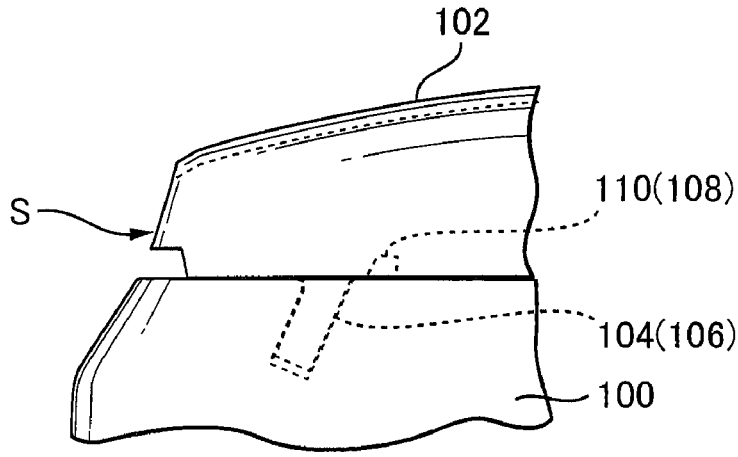
FIG. 1 is a side view of front end portions of a hood and a body case for explaining a concept of an important part of the present invention.
Figure 2:
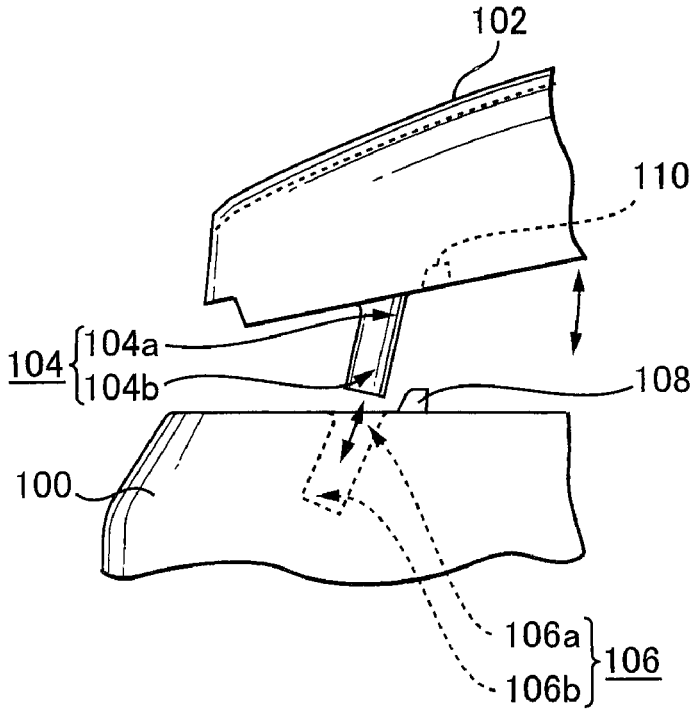
FIG. 2 is side view of front end portions of the hood and the body case for explaining how an inclined pin at a front end portion of the hood is inserted into or pulled out of an inclined bore of the body case.
Figure 3:
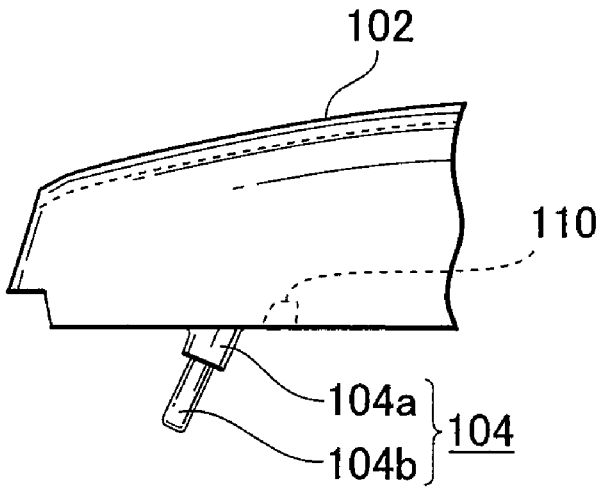
FIG. 3 is a diagram for explaining a modification of the inclined pin at the front end portion of the hood.
Figure 4:
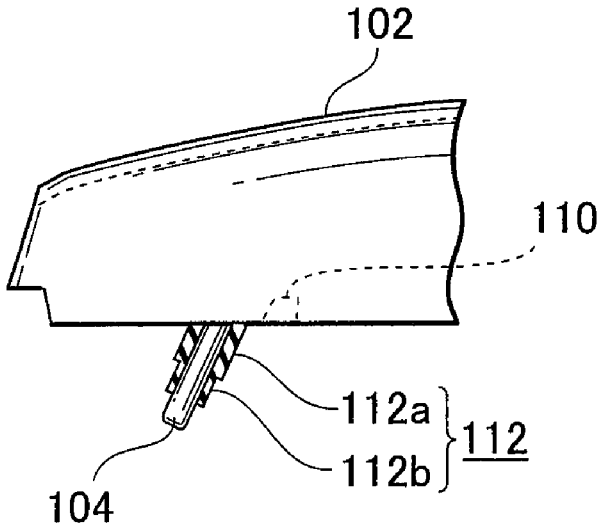
FIG. 4 is a diagram for explaining a modification of an elastic tube attached on the inclined pin at the front end portion of the hood.
Figure 5:
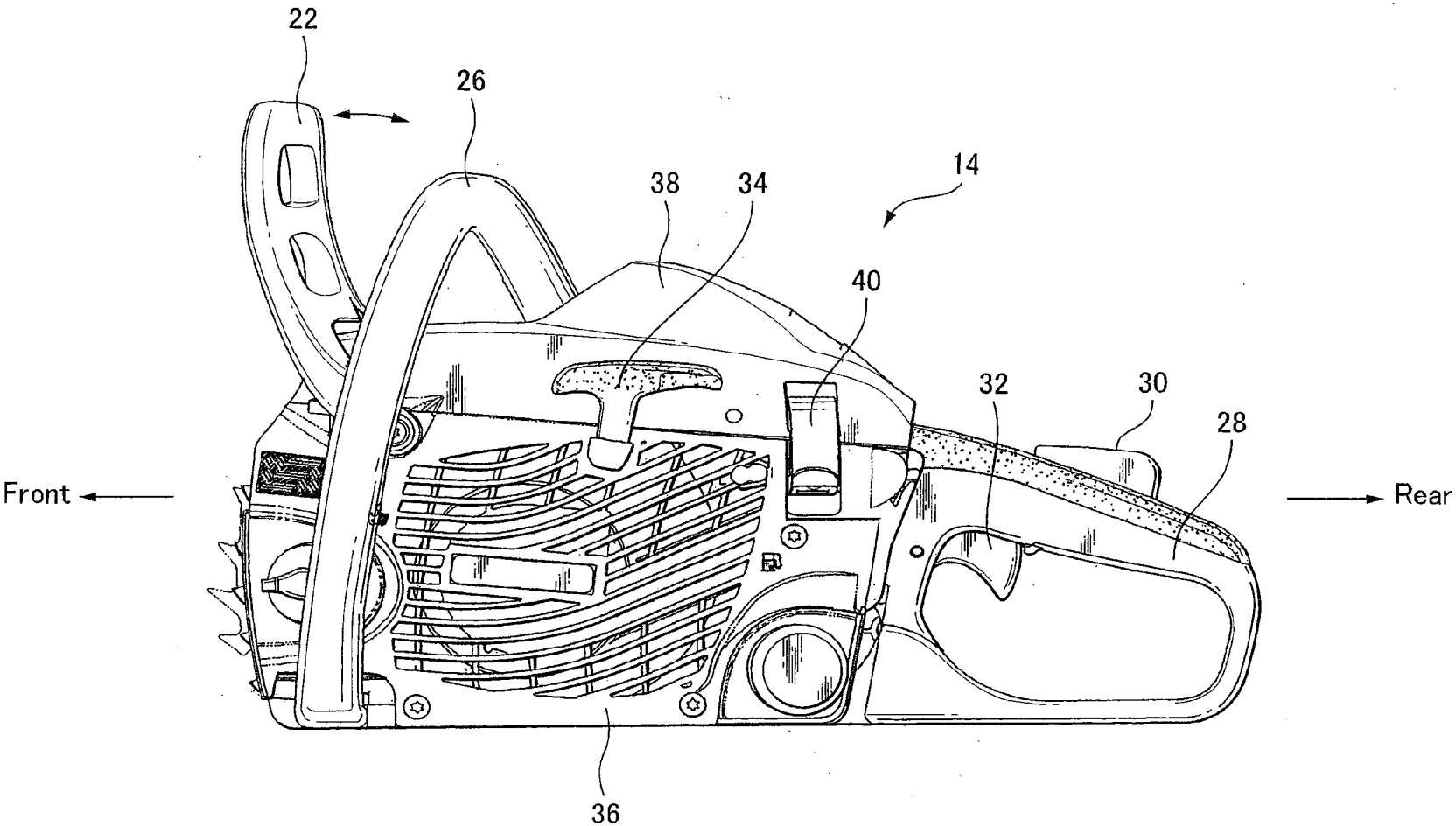
FIG. 5 is a side elevation of a chain saw taken as an embodiment, with a saw chain and a guide lever being removed.
Figure 6:
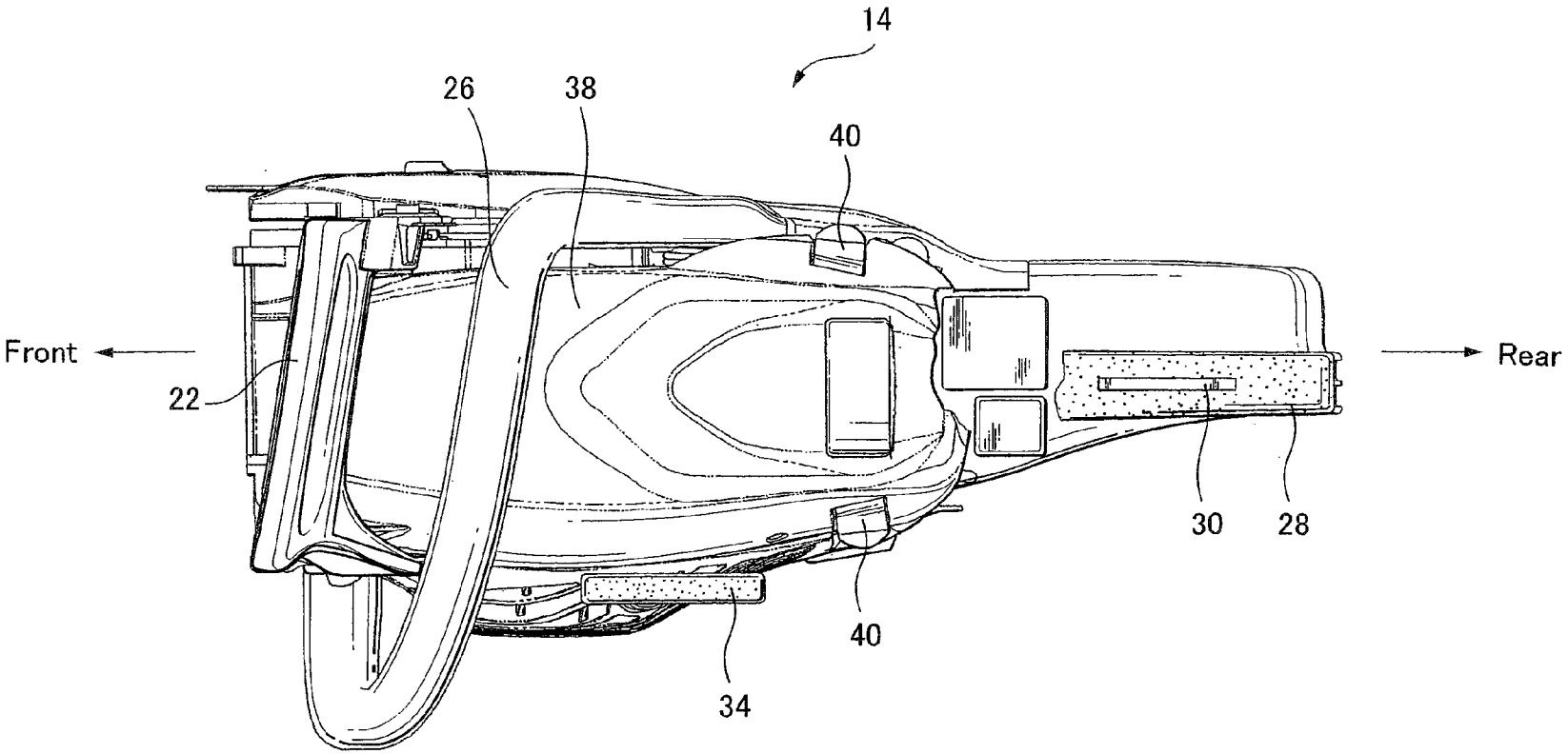
FIG. 6 is a plan view of the same chain saw, with the saw chain and the guide lever being removed.
Figure 7:
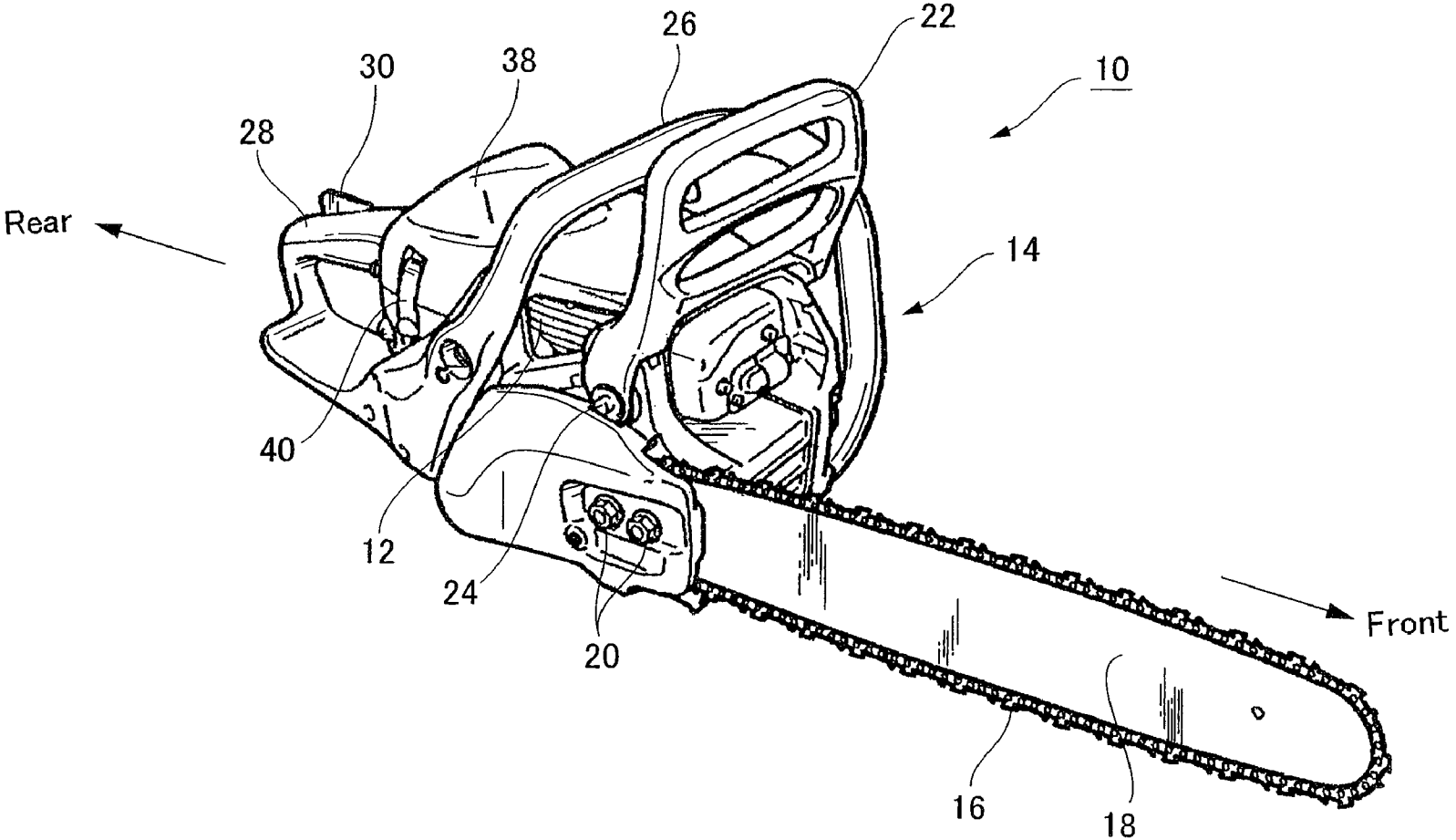
FIG. 7 is a perspective view of the same chain saw, taken from a diagonal front direction.

FIGS. 5 and 6 illustrate a chain saw taken as an embodiment of the invention. FIG. 5 is a side elevation of the chain saw and FIG. 6 is a plan view. FIGS. 5 and 6 show a configuration of the chain saw, in which a saw chain has been removed from the main body to permit an inside look of the chain saw. FIG. 7 is a perspective view of the chain saw, taken from a front diagonal direction.

First referring to FIG. 7, a general construction of the chain saw 10 is explained. The chain saw 10 has a chain saw main body 14 in which a compact internal combustion engine 12 is mounted. The engine 12 is typically a single-cylinder, air-cooled two-cycle gasoline engine. On the chain saw main body 14, a guide bar 18 for guiding a saw chain, which is a cutter-carried chain 16, is removably assembled by volts and nuts.

Next referring to FIGS. 5 and 6, an outline of the chain saw main body 14 is explained. For easier understanding hereafter, one end of the main body 14 where the cutter-carried chain should exist is called a front end, and the other end opposite from the cutter-carried chain 16 is called a back or rear end.

At the front end of the chain saw main body 14, a front hand guard 22 is placed for back and forth swinging movements about a pivot axis 24 (FIGS. 5 and 7). Just behind it, a front handle 26 is placed to extend in a direction across the chain saw main body 14. At a rear portion of the chain saw main body 14, a rear handle 28 is supported to extend straight backward from the chain saw main body 14. On the rear handle 28, a throttle trigger lockout 30 projecting upward and a throttle trigger 32 projecting downward are provided.

An operator will typically grip the rear handle 28 extending backward from the chain saw main body 14 with his/her right hand and will grip the front handle 26 extending in the direction crossing the chain saw main body 14 with his/her left hand when operating the chain saw 10 for logging. The operator can control the output of the engine 12 by pulling up the throttle trigger 32 with his/her right forefinger. The throttle trigger 32 is normally locked by the throttle trigger lockout 30. The operator can unlock the throttle trigger 32 by pressing down the throttle trigger lockout 30 with the ball of his/her right first finger. That is, the operator can control the output of the engine 12 by unlocking the throttle trigger 32 beforehand by pressing the throttle trigger lockout 30 with his/her right hand gripping the rear handle 28 and then pulling and squeezing the throttle trigger 32 with the forefinger of the same right hand.

The position of the hand guard 22 shown in FIGS. 5 to 7 is a brake release position for releasing the brake of the cutter-carried chain 16. By displacing the hand guard 22 nearer to the front handle 26 as illustrated, the chain 16 is permitted to rotate (release of the brake). That is, the hand guard 22 can take two positions, one being a brake release position closer to the front handle 26 (displaced rearward) and the other being a braking position displaced forward away from the front handle 26. When an operator works with the chain saw 10, he/she may displace the hand guard 22 rearward to set it at the brake release position, where the cutter-carried chain 16 is driven to rotate by the engine output. In operation, if the chain saw 10 accidentally kicks back due to a reaction force, and causes the hand guard 22 to hit the operator's hand gripping the front handle 26, which displaces the hand guard 22 forward (braking position), then the cutter-carried chain 16 is stopped. In FIGS. 5 and 6, reference numeral 34 denotes a starter grip. The internal combustion engine 12 is activated swiftly pulling up the starter grip 34.

Figure 8:
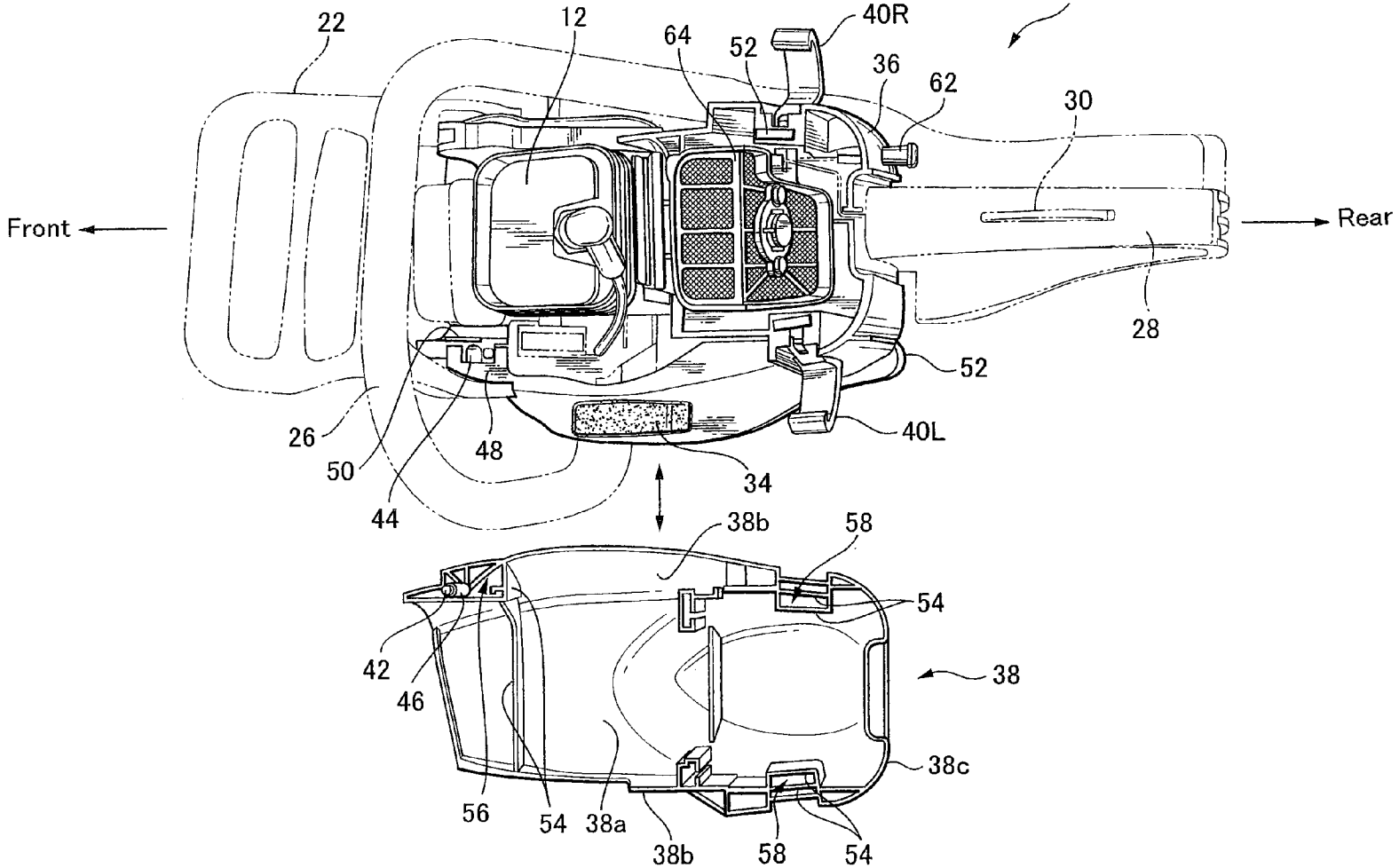
FIG. 8 is a plan view of the same chain saw corresponding to FIG. 6, with its hood being removed from the chain saw and shown beside it to lie in an inside-out orientation.
Figure 9:
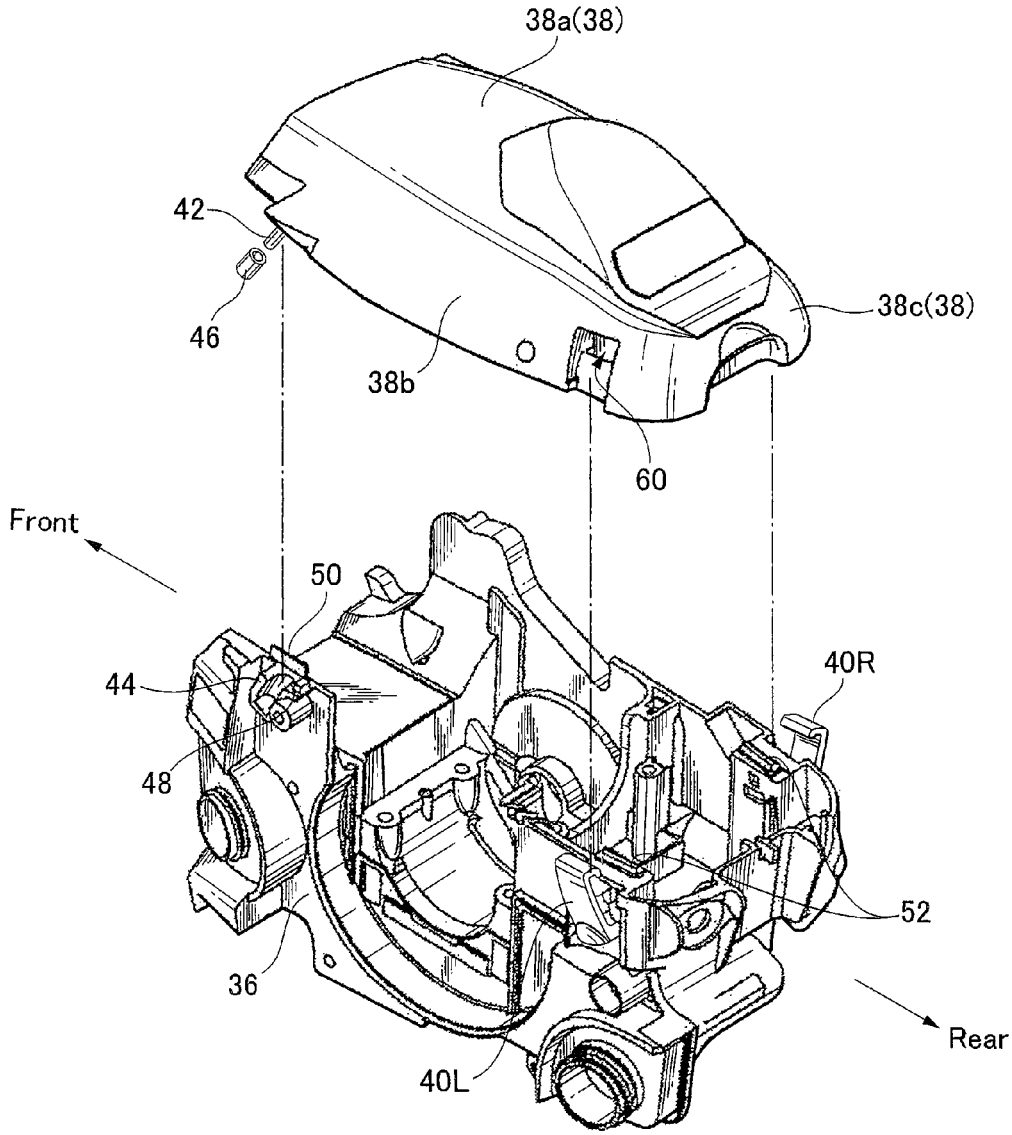
FIG. 9 is an exploded perspective view of the body case and the hood.

FIG. 8 is a plan view of the chain saw main body 14. The chain saw main body 14 has a body case 36 defining its circumference. An open top end of the body case 36 is covered by a hood 38. In FIG. 8, the body case 36 is shown as being uncovered by removing the hood 38. FIG. 9 is a perspective view of the body case 36 and the hood 38 extracted from others.

Both the body case 36 and the hood 38 are made of synthetic resin materials. The hood 38 is locked at its read end to the body case 36 by a pair of right and left hooks 40R and 40L. The front of the hood 38 is held in position by engagement of an inclined pin 42 and a complementary inclined bore 44. By releasing the lock by the pair of hooks 40R, 40L and pulling the inclined pin 42 out from the inclined bore 44, the hood 38 can be removed away from the body case 36. The pair of right and left hooks 40R, 40L that constitute the lock means of the hood 38 are known means for locking the hood 38 to the body case 36 by hooking on the right and left step portions of the hood 38 with the hooks 40R, 40L. However, the step portions of the body case 36 may be designed to incline in their side view such that, when the hooks 40R, 40L are in the locking state, a biasing force is applied from the hooks 40R, 40L to the body case 36 in a vertical direction and in a diagonal, forward direction. Thus, a biasing force is applied to the hood 38 in a direction for urging the inclined pin 42 deeper into the inclined bore 44.

Figure 10:
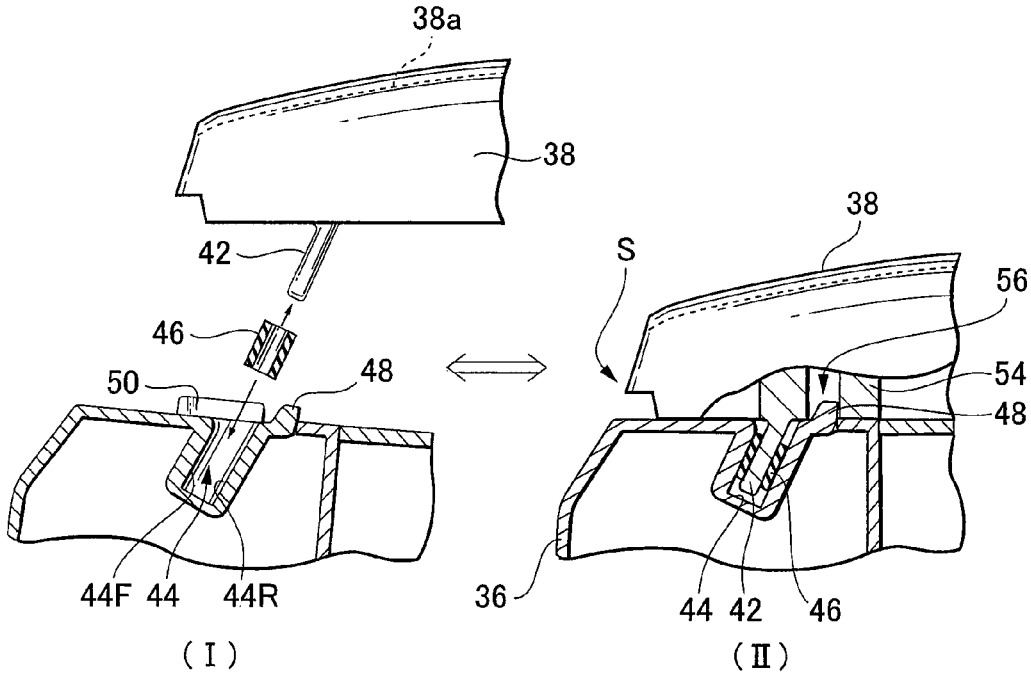
FIG. 10 is a diagram showing a relation between the inclined pin at the front end portion of the hood and the inclined bore of the body case, in which the left half diagram (I) shows the configuration with the hood removed from the body case and the right half diagram (II) shows the configuration with the hood held on the body case.

The body case 36 has the inclined bore 44 at one side of its front end portion. With reference to FIG. 10, the inclined bore 44 has a configuration extending aslant forward as it becomes deeper. The inclined bore 44 may have any cross-sectional configuration, but its front and rear inclined walls 44F, 44R preferably extend in parallel. At the rear end portion of the body case 36, the pair of right end left hooks 40R, 40L are attached to right and left side walls of the body case 36.

With reference to FIG. 8, the hood 38 has a ceiling portion 38*a*, right and left side walls 38*b* and rear end wall. The hood 38, however, does not have a front end wall. In other words, the hood 38 convexly bulges upward, with the right and left side walls 38*b* and the rear end wall 38*c* extending downward from a circumference of the ceiling portion 38*a*, and the front end of the ceiling portion 38*a* defines the front end of the hood (FIG. 8).

As already explained, the hood 38 has the inclined pin 42 at a front end portion for engagement with the inclined bore 44. The inclined pin 42 may be either an integral part of the hood made of a synthetic resin or a metallic pin pierced afterward or embedded by casting into the hood 38. The inclined pin 42 inclines in the same direction as that of the front and rear inclined walls 44F, 44R of the inclined bore 44. More specifically, the inclined pin 42 is a straight pin extending aslant forward toward its lower end, i.e. distal end. An elastic tube 46 is put on the inclined pin 42. The outer diameter of the inclined pin 42 is smaller than the distance between the front and rear inclined walls 44F, 44R of the inclined bore 44, and the outer diameter of the elastic tube 46 is approximately equal to or slightly smaller than the distance between the front and rear inclined walls 44F, 44R of the inclined bore 44.

The inclined bore 44, inclined pin 42 and elastic tube 46 are explained in greater detail. The inclined bore 44 inclines by 30 degrees made by its front and rear inclined walls 44F, 44R relative to the vertical line. Distance between the front and rear inclined walls 44F, 44R is approximately 7 mm. The inclined pin 42 inclines by 25 degrees relative to the vertical line. It has the outer diameter of 4 mm and a circular cross-sectional shape. The elastic tube 46 is made of a synthetic rubber. Its inner diameter is 3 mm, and the outer diameter is 7 mm. That is, the angle of inclination of the inclined pin 42 is smaller than the angle of inclination of the inclined bore 44. The diameter of the inclined pin 42 is smaller than the distance between the front and rear inclined walls 44R, 44L of the inclined bore 44.

Figure 11:
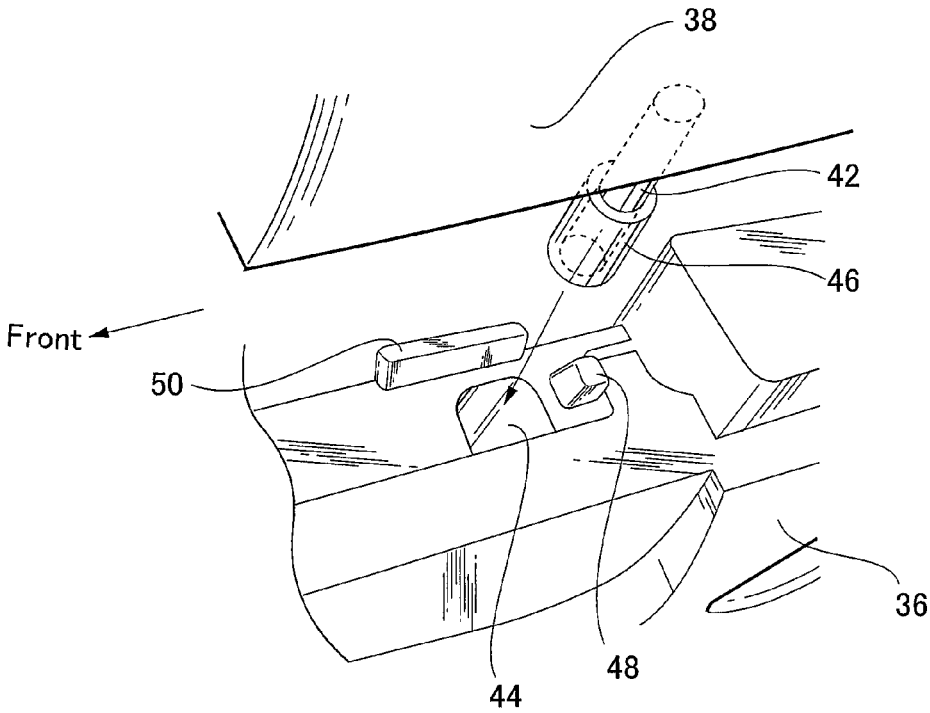
FIG. 11 is an enlarged partial view of a front end portion of the body case including the inclined bore and an adjacent first projection.

With reference to FIGS. 10 and 11, the body case 36 has a first projection 48 and a guide wall 50 both projecting upward behind and near the inclined bore 44 in the front end portion of the body case 36. In the rear end portion of the body case 36, a second projection 52 is formed to project upward near the right end left hooks 40R, 40L as shown in FIG. 8.

With reference to FIG. 8 where the hood 38 is shown to lie in an inside-out orientation, the hood 38 has a plurality of ribs 54 inside. These ribs 54 define first and second latch bores 56, 58 for receiving the first and second projections 48, 52 for fix the relative alignment. In the rear end portion of the hood 38, step portions 60 are formed in the right and left side walls 38*b* as best shown in FIG. 9. The hooks 40R, 40L engage with these step portions 60 respectively. Reference numeral 62 of FIG. 8 denotes a choke knob.

With reference to FIG. 8 again, the body case 36 accommodates a two-cycle single-cylinder engine 12 in its front portion, and an air cleaner 64 in a rear end portion. The air cleaner 64 is fixed to the body case 36 with a pair of screws 66 (FIGS. 12 and 13).

Figure 12:
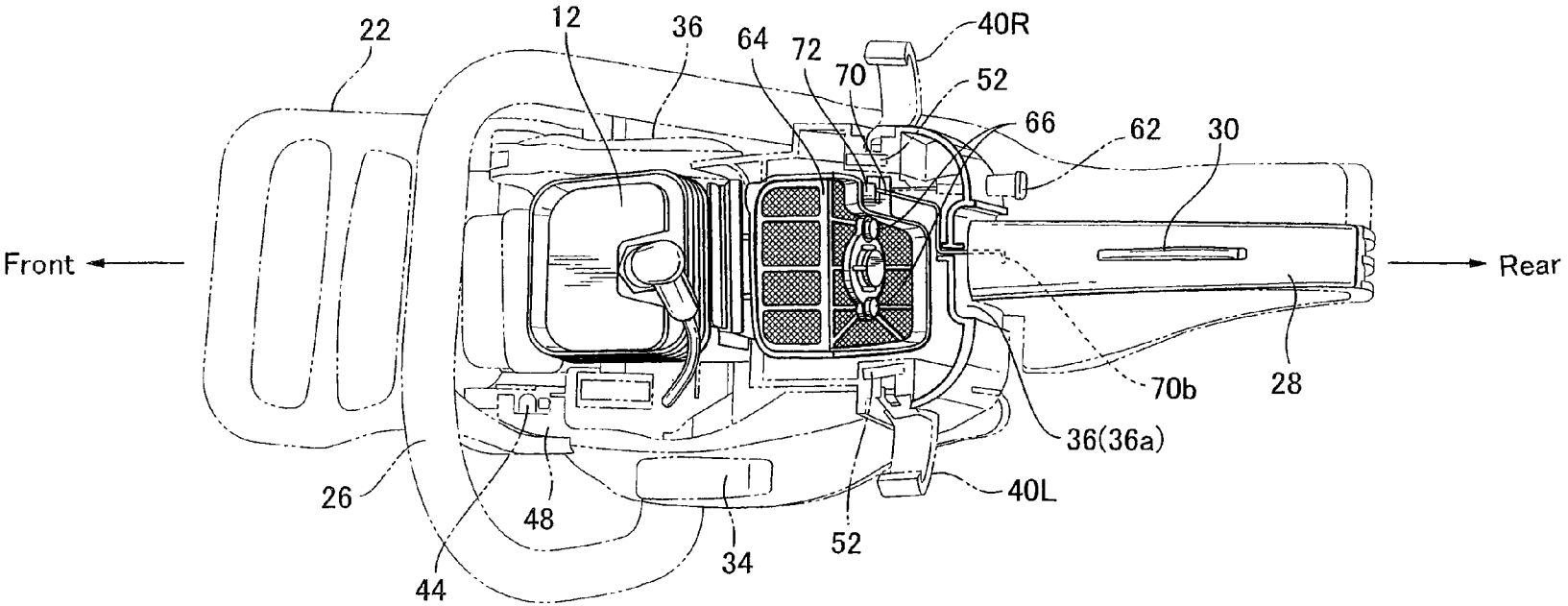
FIG. 12 is plan view of the chain saw, with its hood removed, in which an air cleaner and a rear end wall of the body case near the air cleaner are shown by solid lines to explain the configuration of a linkage rod for controlling the engine output, which extends past the air cleaner and the rear end wall of the body case and then enters into a rear handle.

FIG. 12 is a view corresponding to FIG. 8. To draw observers' attention to elements in the rear region of the body case, FIG. 12 shows only these elements by solid lines and the others by imaginary line. With reference to FIG. 12, a linkage rod 70 is placed in the body case 36 to extend past the air cleaner 64 like in the existing apparatuses. As best shown in FIG. 13, the linkage rod 70 is connected with its front end 70*a* to a throttle lever, not shown. When the linkage rod 70 moves forward, the engine output increases. When the linkage rod 70 moves rearward, the engine output decreases.

Figure 13:
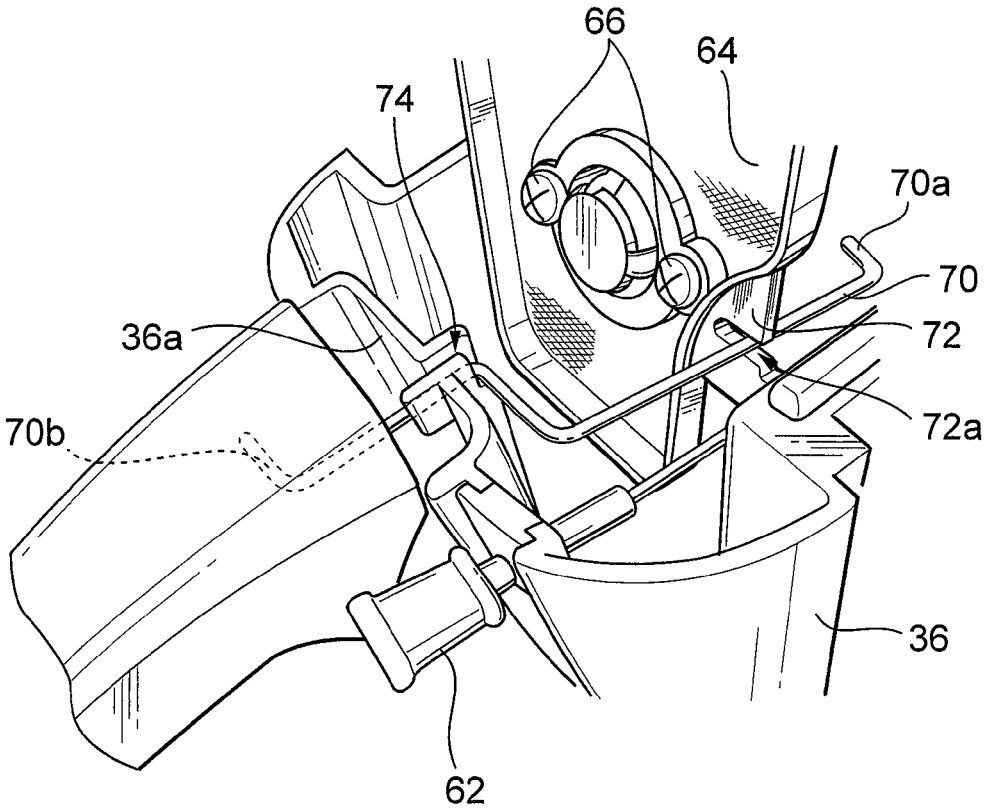
FIG. 13 is an enlarged view of a portion including the air cleaner and a front end portion of the rear handle.

Still referring to FIG. 13, the linkage rod 70 is bent midway. Its rear end portion 70*b* beyond an L-bending turning point is positioned inside the rear handle 28 and gets in contact with an upper end of the throttle trigger 32 already explained. When an operator pulls the throttle trigger 32, the rear end portion 70*b* of the linkage rod 70 is pushed forward by the throttle trigger 32, and the linkage rod 70 moves forward.

Figure 14:
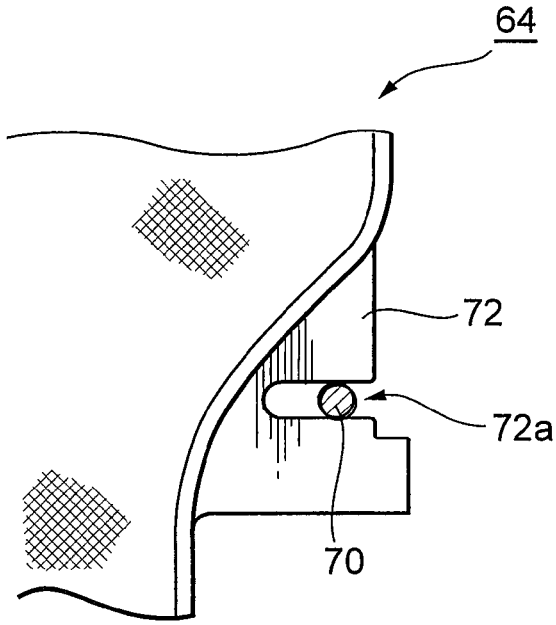
FIG. 14 is a view of a side portion of the air cleaner, taken from a rear direction to explain that a side flange is provided to extend aside the air cleaner and a side slit is provided in the side flange to permit the linkage rod to pass through the side slit.

With reference to FIGS. 13 and 14, the air cleaner 64 has a side flange 72 extending laterally. The side flange 72 has a side slit 72*a* opened at an outer side edge. Width of the side slit 72*a* is substantially equal to the diameter of the linkage rod 70 (FIG. 14). The linkage rod 70, received in the side slit 72*a*, extends past the air cleaner 64.

Figure 15:
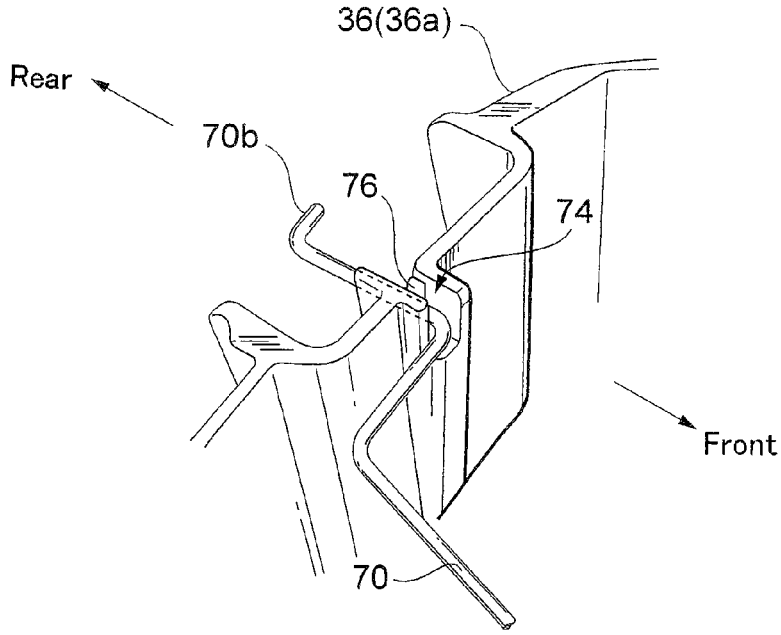
FIG. 15 is a view of the rear end wall of the body case, taken from a front diagonal direction.
Figure 16:
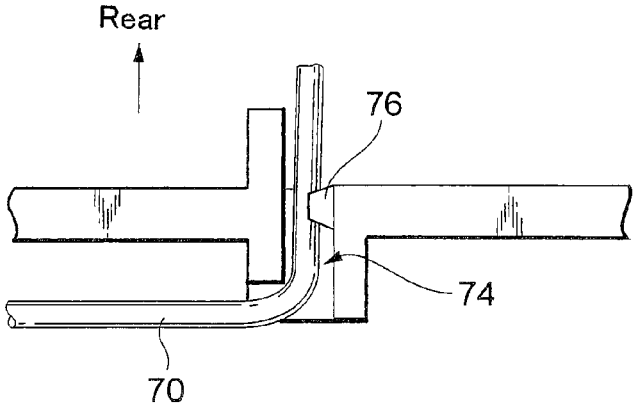
FIG. 16 is a plan view of the rear end wall of the body case.
Figure 17:
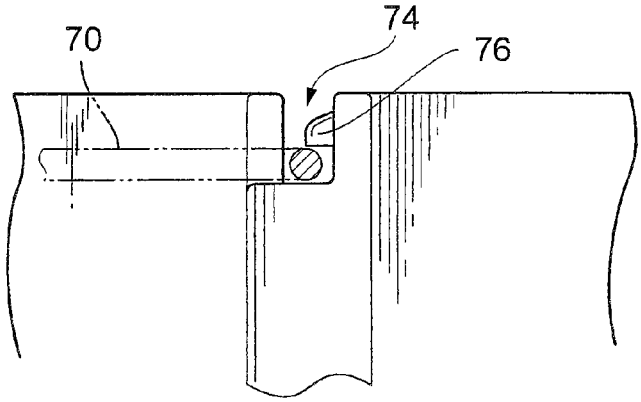
FIG. 17 is a plan view of the rear end wall of the body case.
Figure 18:
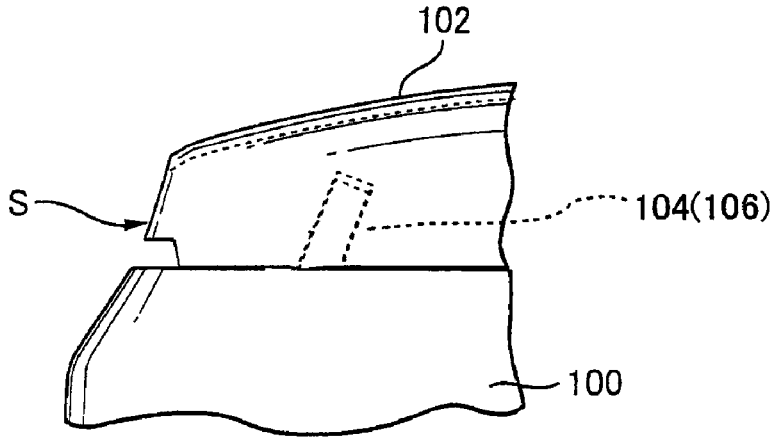
FIG. 18 is a side view of front end portions of a hood and body case for an aspect of the present invention.

The rear end wall 36*a* of the body case 36 has a vertical groove 74 formed in a part of the wall 36*a* that the linkage rod 70 should pass through. FIG. 15 shows this portion around the vertical groove 74 in an enlarged scale. One of the pair of wall surfaces defining the vertical groove 74 has a third projection 76. This third projection 76 acts to narrow the width of the vertical groove 74 to the size substantially equal to the diameter of the linkage rod 70. The linkage rod 70 is seated in the vertical groove 74 when pushed down up to beyond the third projection 76. In this condition, the linkage rod 70 is prevented from easily getting out of the vertical groove 74 upward by the third projection 76. Upon the need of replacement of parts or some other necessity, the linkage rod 70 can be removed from the vertical groove 74 by shifting the linkage rod 70 aside to the portion narrowed by the third projection 76 and then pulling it upward.

As such, by holding mid portions of the linkage rod 70 in the vertical groove 64 having a third projection and in the side slit 72*a* of the air cleaner 64 (side flange 72), rolling or loosening of the linkage rod 70 can be restricted.

The chain saw 10 according to the embodiment of the invention gives a user a wide access to components contained in the body case 36, such as the air cleaner 64 and the engine 12, by removing the hood 38 away from the body case 36 when he/she needs cleaning of the air cleaner or maintenance of the engine, for example. With reference to FIG. 11, when the user puts the hood 38 on the body case 36 to cover it again, he/she had better keep the hand guard 22 laid down forward, i.e. set at the braking position, to not hit or knock the hand guard 22 with front end of the hood 38.

Then, the user may insert the inclined pin 42 at one side of a front end region of the hood 38 into inclined bore 44 of the body case 36. The body case 36 has a guide wall 50 adjacent to the inclined bore 44. By contact with the inner surface of the side wall 38*b* of the hood 38, this guide wall 50 first guides the hood 38 to the position of for proper alignment with the body case 36 in the right and left directions and next guides the front end portion of the hood 38 to a proper mounting position. The guide wall 50 may be provided on the part of the hood 38 instead.

Once the inclined pin 42 of the hood 38 enters into the inclined bore 44 of the body case 36 under the guide by the guide wall 50, the first projection 48 just behind the inclined bore 44 enters into the first latch bore 56 of the hood 38 and acts to determine the position of the front end of the hood 38. Concurrently, the right and left second projections 52 at the rear end portion of the body case 36 enter into the right and left second latch bores 58. As a result, the entirety of the hood 38 is set on a proper mounting position. After the positioning of the hood 38 is completed, the rear end portion of the hood 38 may be locked with the right and left hooks 40R, 40L. In this manner, the hood 38 can be united to the boy case 36.

The hood 38 that covers the engine 12 and the air cleaner 64 behind it, both housed in the body case 36, is locked at its rear end portion by the pair of right and left hooks 40R, 40L, and substantially locked at its front end portion by engagement between the inclined pin 42 and the inclined bore 44. Therefore, even in operation of the chain saw 10, it is prevented that the hood 38 undesirably separates from the body case 36. In addition, since the elastic tube 46, which is a buffer material, exists between the inclined pin 42 and the inclined bore 44, loosening of the front end portion of the hood 38 is prevented.

Upon removing the hood 38 for the purpose of maintenance of the engine 12, for example, after the right and left hooks 40R, 40L are released, a user can easily disengages the inclined pin 42 from the inclined bore 44 by lifting the front end of the hood 38 with a finger at the front edge of the ceiling portion 38*a* forming the front end of the hood 38. Once the inclined pin 42 is pulled out of the inclined bore 44, the hood 38 is freed from the body case 36.

Heretofore, a preferred embodiment has been explained. However, the invention is not limited to the described embodiment. Instead, the present invention contemplates various changes or modifications of the explained embodiment. For example, placement of the inclined pin 42 and the inclined bore 44 may be inverted such that the body case 36 has the inclined pin 42 and the hood 38 has the inclined bore 44. In his case, the inclined pin 42 of the body case 36 preferably extends aslant rearward from the boy case 36 toward its distal end while the inclined bore 44 in the hood 30 extends aslant rearward from its open end toward its deep end.

What is claimed is:

1. A work apparatus with an internal combustion engine, comprising:

a body case housing the internal combustion engine and having an open top end;

a hood for covering said open top end of the body case, wherein the hood comprises a first end and a second end;

an inclined pin extending aslant downward from a portion near to said first end of said hood such that a distal end of the inclined pin is nearer to said first end of the hood than a proximal end of the inclined pin;

an inclined bore provided at a position of said body case for confrontation with said inclined pin and having an open end opening upward, said inclined bore being configured such that a deep end thereof is nearer to one end of the body case corresponding to said first end of the hood than said open end of the inclined bore; and a lock means for releasably locking a portion of said hood including said second end thereof to a portion of the body case including an other end thereof.

2. The work apparatus according to claim 1 further comprising an elastic tube enveloping an outer circumference of said inclined pin.

3. The work apparatus according to claim 1 wherein said body case further accommodates an air cleaner, wherein said air cleaner is located in a region nearer to said other end than said internal combustion engine.

4. The work apparatus according to claim 1 wherein a front end perimeter of said hood is indented at least near said inclined pin to maintain a space between the hood and the body case even when the hood is locked to cover the body case.

5. The work apparatus according to claim 1 wherein said inclined pin and said inclined bore are provided in one side of a portion near said first end of the hood and said corresponding one end of the body case.

6. The work apparatus according to claim 1 wherein the work apparatus is a chain saw.

7. The work apparatus according to claim 2 wherein said body case further accommodates an air cleaner, wherein said air cleaner is located in a region nearer to said other end than said internal combustion engine, and a front end perimeter of said hood is indented at least near said inclined pin to maintain a space between the hood and the body case even when the hood is locked to cover the body case.

8. The work apparatus according to claim 7 wherein said inclined pin and said inclined bore are provided in one side of a portion near said first end of the hood and said corresponding one end of the body case.

9. A work apparatus with an internal combustion engine, comprising:

a body case housing the internal combustion engine and having an open top end;

a hood for covering said open top end of the body case, wherein the hood comprises a first end and a second end;

an inclined pin extending aslant upward from a portion near to one end of said body case such that a distal end of the inclined pin is nearer to said one end of the body case than a proximal end of the inclined pin;

an inclined bore provided at a position of said hood for confrontation with said inclined pin and having an open end opening downward, said inclined bore being configured such that a deep end thereof is nearer to one end of the body case corresponding to said first end of the hood than said open end of the inclined bore; and a lock means for releasably locking said second end of the hood to an other end of the body case.

10. The work apparatus according to claim 9 further comprising an elastic tube enveloping an outer circumference of said inclined pin.

11. The work apparatus according to claim 9 wherein said body case accommodates an air cleaner in a region nearer to said other end in addition to said internal combustion engine.

12. The work apparatus according to claim 9 wherein a front end perimeter of said hood is intended at least near said inclined pin to maintain a space between the hood and the body case even when the hood is locked to cover the body case.

13. The work apparatus according to claim 9 wherein said inclined pin and said inclined bore are provided in one side of a portion near said first end of the hood and said corresponding one end of the body case.

14. The work apparatus according to claim 9 wherein the work apparatus is a chain saw.

15. The work apparatus according to claim 10 wherein said body case accommodates an air cleaner in a region nearer to said other end in addition to said internal combustion engine, and a front end perimeter of said hood is indented at least near said inclined pin to maintain a space between the hood and the body case even when the hood is locked to cover the body case.

16. The work apparatus according to claim 15 wherein said inclined pin and said inclined bore are provided in one side of a portion near said first end of the hood and said corresponding one end of the body case.

17. The work apparatus of claim 1, wherein said inclined pin is receivable or insertable in the inclined bore.

18. The work apparatus of claim 9, wherein said inclined pin is receivable or insertable in the inclined bore.

* * * * *